US009193142B1

(12) United States Patent
Moorlag et al.

(10) Patent No.: US 9,193,142 B1
(45) Date of Patent: Nov. 24, 2015

(54) UV CURABLE TRANSFIX LAYER PRINTING SYSTEMS AND METHODS FOR DIGITAL OFFSET PRINTING

(71) Applicant: XEROX Corporation, Norwalk, CT (US)

(72) Inventors: Carolyn Moorlag, Mississauga (CA); Gabriel Iftime, Cupertino, CA (US); C. Geoffrey Allen, Waterdown (CA); Marcel Breton, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/507,859

(22) Filed: Oct. 7, 2014

(51) Int. Cl.
*B41J 2/145* (2006.01)
*B41F 7/32* (2006.01)
*B41F 7/02* (2006.01)

(52) U.S. Cl.
CPC .... *B41F 7/32* (2013.01); *B41F 7/02* (2013.01)

(58) Field of Classification Search
CPC ..... B41J 2/145; B41J 2/15; B41J 11/002; B41M 7/0081; Y10T 428/24802; B41F 7/02; B41F 7/22; B41F 7/32
USPC ..... 347/40
See application file for complete search history.

(56) References Cited

U.S. PATENT DOCUMENTS 8,287,117 B2 * 10/2012 Ageishi ..... 347/102
8,408,689 B2 * 4/2013 Roof et al. ..... 347/99
8,459,762 B2 * 6/2013 Yui et al. ..... 347/6

* cited by examiner

*Primary Examiner* — Alessandro Amari
*Assistant Examiner* — Michael Konczal
(74) *Attorney, Agent, or Firm* — Ronald E. Prass, Jr.; Prass LLP

(57) ABSTRACT

The disclosed systems and methods provide an ink-based digital printing system for printing high quality images on a wide latitude of image receiving media. The disclosed systems and methods employ a UV curable base (transfix) layer deposited on an intermediate image transfer member that is then at least partially cured prior to an aqueous ink being deposited on the base layer to form a digital image thereon. Once the images are formed on the base layer, a drying device is optionally used to reduce a water content of the aqueous ink images on the base layer prior to transfer of the images to an image receiving media substrate. At transfer, the images and at least a portion of the base layer are transferred to the image receiving media substrate, the images being sandwiched between the portion of the base layer and the image receiving media substrate.

23 Claims, 3 Drawing Sheets

UV CURABLE TRANSFIX LAYER PRINTING SYSTEMS AND METHODS FOR DIGITAL OFFSET PRINTING

FIELD OF DISCLOSURE

The disclosure relates digital image forming methods and image marking systems that employ an intermediate UV-curable base or transfix layer on which aqueous ink images are formed by any one of a number of digital image marking means, the base or transfix layer being used as a transfer medium for transferring the digital aqueous ink images to image receiving media substrates.

BACKGROUND

Tremendous interest continues in developing new printing and image forming platforms with wide media latitude and high image quality. Extensibility in the form of future growth opportunities in all manner of digital marking devices from office markets to production markets are targeted. Digital offset and aqueous transfix are both currently pursued as printing methods in associated platforms that may demonstrate adaptability to wider media latitude. In pursuing the further development and growth in certain markets, it is recognized that certain inherent limitations arise. Variable data digital offset lithographic image forming is generally considered to lack feasibility in the office market. Aqueous transfix digital image forming requires formulation of robust, aqueous inks, and newly formulated transfix pre-coats for office to production printing.

Digital printing is generally understood to refer to systems and methods in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. U.S. patent application Ser. No. 13/095,714 ("714 Application"), entitled "Variable Data Lithography System," filed on Apr. 27, 2011 by Timothy Stowe et al., which is commonly assigned, and the disclosure of which is hereby incorporated by reference herein in its entirety, describes an exemplary variable data lithography system for ink-based digital printing.

"Ink-based digital printing" or "digital offset printing" systems and methods may otherwise include an ink jetting process in which a piezoelectric ink jet print head may be used to apply ink to an intermediate transfer material layer. The jetted ink may be disposed on a pre-coat layer, which can be in the form of a partially dried mixture of polymeric binder, liquids and release agent, such as oil, that is capable of supporting the printed intermediate image for subsequent transfer to an image receiving media substrate. The pre-coat layer may require different levels of drying prior to suitability to apply the jetted ink. The intermediate image is transferred by contact between a surface of an intermediate transfer component and the image receiving media substrate, typically with the assistance of a pressure roller or drum to create a transfer nip.

After printing, a conventional pre-coat layer is at the surface of the image and may not provide adequate robustness depending on the application.

SUMMARY

It would be advantageous to develop a common image forming method that may be adaptable to various digital image forming systems in order to produce repeatably increased image quality images on image receiving media substrates with wide latitude in the image marking materials, the image transfer options and the wide variety of image receiving media substrates that may be employed in the digital image forming processes. These advantages would continue to advance the development and marketability of ink-based digital printing systems and methods suitable for office to production printing.

In exemplary embodiments, the disclosed systems and methods may provide ink-based digital printing systems configured for printing aqueous inks onto a transparent intermediate base or transfix layer removably applied to an intermediate transfer member.

In embodiments, a transparent UV-curable base or transfix layer may be formed on the intermediate transfer member and at least partially cured prior to a digital ink image being formed thereon.

In embodiments, a variable data digital lithographic printing process may be employed to form the images on the partially-cured transparent UV-curable base or transfix layer. In other or alternate embodiments, a digital ink jetting process may be employed to form the images on the partially-cured base or transfix layer.

The disclosed embodiments result in printing platforms with wide latitude in the selection and employment of various image receiving media substrate materials that are suitable for office to production printing. The provided printing systems and methods enable production of high quality and robust prints on a wide variety of image receiving media substrates.

Exemplary embodiments are described in this disclosure. It is envisioned, however, that any system that incorporates features of the described systems may be encompassed by the scope and spirit of the exemplary embodiments.

DETAILED DESCRIPTION

Figure 1:
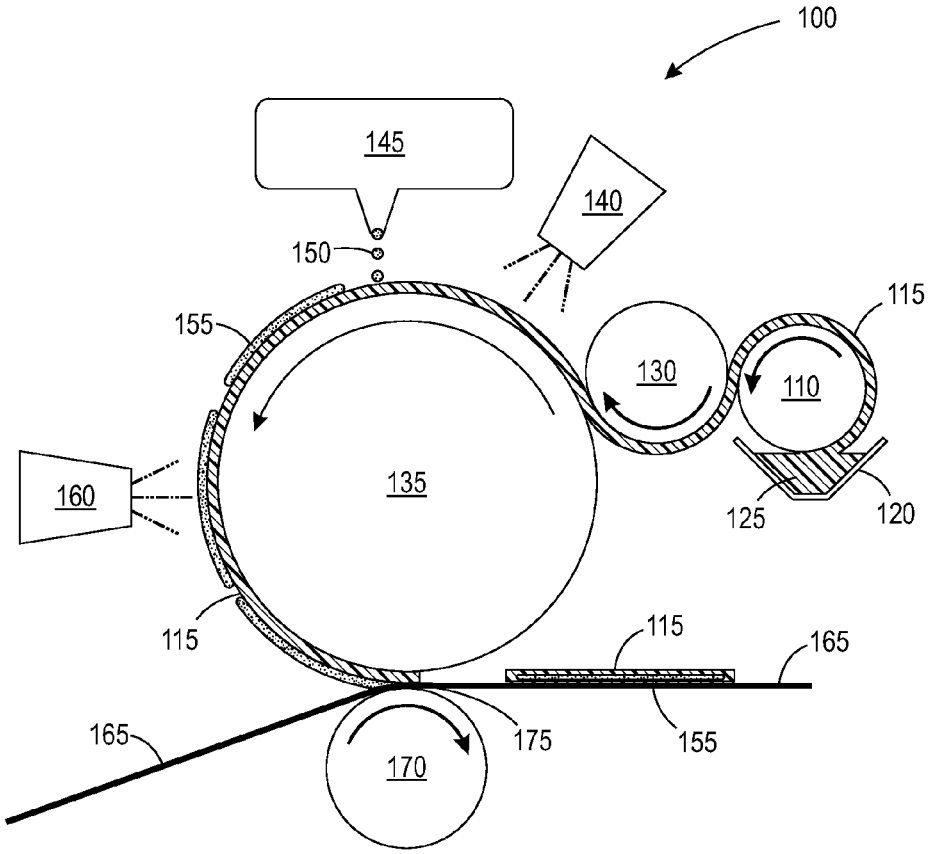
FIG. 1 illustrates a side diagrammatical view of an indirect ink-based digital transfix printing system according to this disclosure.

Exemplary embodiments are intended to cover all alternatives, modifications, and equivalents as may be included within the spirit and scope of the systems and methods as described.

Reference is made to the drawings to accommodate general understanding of digital printing on a transparent UV-curable base or transfix layers for use in offset-type digital printing systems and methods in accordance with embodiments. Digital ink offset printing systems and methods are provided that accommodate a wide latitude in the selection and use of various image receiving media substrate materials, and that enable high image quality image processing on this wide latitude of materials. Related art systems such as ink-based digital printing systems and aqueous transfix printing systems enable transfer of an inked image to a printable medium in a process in which a layer onto which the ink is deposited on the intermediate transfer member or central imaging member remains on the transfer or imaging member after transfer of the ink.

In embodiments, the disclosed systems and methods may be configured to apply a transparent UV-curable liquid layer onto a receiving member such as an intermediate transfer member or central imaging member. A thickness of the transparent UV-curable liquid layer may be in a range of about 0.3 to 2.0 microns. The transparent UV-curable liquid layer is then at least partially cured to a level that will effectively limit the spread of an aqueous ink on the liquid layer, when applied. The UV partial curing may be broad spectrum curing. In embodiments, the UV partial curing may be monochromatic, using a UV-Light Emitting Diode (LED) for example. In embodiments, a depth cure may be targeted rather than a surface cure. An ink-based digital image may then be formed on the partially cured transparent UV-curable liquid layer. The ink-based digital image may then be dried on the transparent UV-curable liquid layer. The receiving member may be configured for fully releasing the applied transparent UV-curable liquid layer with the ink-based digital image formed thereon when the liquid layer is pressed onto an image receiving media substrate at a transfer nip formed of the receiving member and other mechanical components. In a preferred embodiment, the transparent UV-curable layer is 100% transferrable from the receiving member surface to the image receiving media substrate.

In embodiments, a cure system may be configured to expose the transparent UV-curable liquid layer formed on the receiving member surface to radiation for at least partially curing the transparent UV-curable liquid layer.

In embodiments, the transparent UV-curable liquid layer and the particular inked image formed thereon may be dried using a separate drying system. The need for drying may be minimized based on a composition of the transparent UV-curable liquid layer that may permit and/or promote water absorption into the at least partially cured transparent UV-curable liquid layer, and absorption that may occur (or be permitted to occur) into certain printable image receiving media substrates, such as paper stock.

In embodiments, the transparent UV-curable liquid layer may be applied to the receiving member to form a sub-micron surface layer. The transparent UV-curable liquid for forming the liquid layer may comprise polar components such as acrylates or propenoates that are salts and esters of acrylic acid. Acrylate and methacrylate monomers are understood to contain reactive vinyl functional groups that facilitate formation of acrylate polymers. Exemplary acrylates may include acrylate monomers or polymers such as polyester acrylates including Sartomer CN294E, Sartomer CD 501, and Sartomer CN 2256. UV-curable components allow wetting of the aqueous ink to the receiving member surface. The receiving member surface, in embodiments, may be formed at least partially of low surface energy elastomers such as silicones and fluorosilicones to promote temporary retention of the transparent UV-curable liquid layer on the receiving member, and then to promote effective transfer of the transparent UV-curable liquid layer from the receiving member to the image receiving media substrate at the transfer nip.

The applied transparent UV-curable liquid layer may be partially cured at a curing station or UV-cure system configured for at least partial curing to inhibit excessive spreading of aqueous ink over the UV-curable liquid layer surface in its liquid state. Additionally, spreading of ink drops on the partially cured UV-curable liquid layer may be controlled based on an amount or extent of partial cure of the applied UV-curable liquid layer.

In preferred embodiments, jetted ink drop sizes may be controlled to a diameter of 55-60 microns, which is suitable for 600 DPI resolution.

FIG. 1 illustrates a side diagrammatical view of an indirect ink-based digital transfix printing system 100 according to this disclosure. In the illustrated system 100, a transparent UV-curable liquid 125 may be provided, for example, via some manner of liquid source or liquid reservoir 120. The transparent UV-curable liquid 125 may be transported from the liquid source or liquid reservoir 120 via one or more transport mechanisms including, for example, one or more transport rollers 110,130 that may be usable to deposit a layer 115 of the transparent UV-curable liquid on a surface of an intermediate imaging member 135. The deposited layer 115 of the transparent UV-curable liquid may be in a range of about 0.3 to 2.0 microns.

The surface of the intermediate imaging member 135 may be formed of a material that promotes temporary adhesion of the layer 115 of the transparent UV-curable liquid to the surface, and then promotes or facilitates release of layer 115 of the transparent UV-curable liquid at the transfer nip 175 as described below. At least the surface of the intermediate imaging member 135 may be formed of a material having a comparatively low surface energy. Such a material may be selected from classes of materials known commonly as silicones or fluorosilicones. Although depicted in FIG. 1 as a drum-type member, the intermediate imaging member 135 may be configured as a drum, a belt, or other intermediate transfer component.

It should be noted that the depicted embodiment of an apparatus for forming the transparent UV-curable liquid layer 115 on the surface of the intermediate imaging member 135 is intended to be exemplary only, and not in any way limiting as to a configuration of any apparatus or device that may be used to deposit the layer on the intermediate imaging member 135. As noted above, the UV-curable liquid layer 115 may be applied to the surface of the intermediate imaging member 135 at the sub-micron level.

A curing device 140 (or UV-cure system) may be provided for at least partially curing the applied transparent UV-curable liquid layer 115 on the surface of the intermediate imaging member 135. The at least partial curing, whether a surface curing or a depth during, may inhibit excessive spreading of aqueous ink over the transparent UV-curable liquid layer surface when the aqueous ink is applied thereto, as described further below.

A digital ink-based marking device may be used to deposit inked images on the at least partially cured surface of the transparent UV-curable liquid layer 115. As shown in FIG. 1, the digital ink-based marking device may comprise an ink-jetting-type print head 145 that may direct an aqueous ink marking material 150 toward the partially cured surface of the transparent UV-curable liquid layer 115 to form one or more digital images 155 thereon. Compatibility between the aqueous ink marking material 150 and the partially cured surface of the transparent UV-curable liquid layer 115 may be controlled in a manner that is intended to limit spot size and spreading of the aqueous ink marking material 150, as discussed in detail above. Other configurations of digital ink-based marking devices including, but not limited to, variable data digital lithographic image forming devices or image marking devices or other ink-based digital marking systems may be employed to deposit an aqueous ink marking material 150 forming one or more digital images 155 on a surface of the transparent UV-curable liquid layer 115.

A heating device 160 may be provided to control the temperature of the one or more ink-based digital images 155. The heating device 160 may be used to at least partially dry the aqueous ink marking material 150 forming the one or more digital images 155. A level of drying may be optimized and/or minimized for a particular combination of materials forming the aqueous ink marking material 150, the transparent UV-curable liquid layer 115, and an image receiving media substrate 165. In a specific example, drying of ink may be minimized due to some water absorption into the partially cured UV-curable liquid layer 115 and a capacity for absorption of water into the image receiving media substrate 165. These capacities may be modifiable dependent on an area coverage for the one or more digital images 155.

The intermediate imaging member 135 may transport the one or more digital images 155 formed (and dried) on the partially cured transparent UV-curable liquid layer 115 toward a transfer nip 175 formed, for example, between the intermediate imaging member 135 and an opposing pressure roller 170. Again here, it should be noted that, although depicted as a conventional transfer nip 175, the configuration of a transfer component for transferring prepared images from a surface of the intermediate imaging member 135 to a surface of an image receiving media substrate 165 is not intended to be limited to the depiction shown in FIG. 1.

The image receiving media substrate 165 may be conveyed between the intermediate imaging member 135 and the transfer or pressure roller 170. Optional heaters (not shown) may be provided upstream of the transfer nip 175 in a process direction, or in association with the transfer or pressure roller 170 at the transfer nip, to pre-heat a surface of the image receiving media substrate 165 to facilitate receiving an image transferred from the intermediate imaging member 135.

As the image receiving media substrate 165 is conveyed between the intermediate imaging member 135 and the transfer or pressure roller 170, the one or more digital images 155 and a portion of the partially cured transparent UV-curable liquid layer 115 may be completely (100%) transferred onto the image receiving media substrate 165. Appropriate pressure may be maintained between the opposing roller surfaces so that the one or more digital images 155 and the portion of the partially cured transparent UV-curable liquid layer 115 are optimally transferred to the surface of the image receiving media substrate 165.

A further fixing or a fusing device may be provided downstream of the transfer nip 175 in a process direction to finally fix or fuse the one or more digital images 155 and the portion of the partially cured transparent UV-curable liquid layer 115 on the surface of the image receiving media substrate 165.

A printing process using the system shown in FIG. 1 may comprise a digital media marking or printing component for jetting, or otherwise delivering, aqueous ink onto a partially cured layer of a UV-curable transparent vehicle that has been thinly deposited onto a low surface energy transfix drum or belt. The aqueous ink used may be an inexpensive pigmented or dye-based ink. Following single-color (or multi-color) printing, the partially cured layer of the UV-curable transparent vehicle may be transferred 100% to paper, or to an image receiving media substrate formed of another material. As indicated briefly above, drying of the aqueous ink onto the partially cured layer of the UV-curable transparent vehicle may be minimized due to elements of water absorption into the partially cured layer, and water absorption into the paper, but is generally considered to be dependent on an area coverage for the aqueous ink. Media latitude is broadened compared to direct to paper image transfer or image formation due to the ability to remove water before transfer to print. The resultant images are robust due to the presence UV-curable layer overlying the one or more digital images as deposited on the image receiving media substrate, particularly following a final cure.

Figure 2:
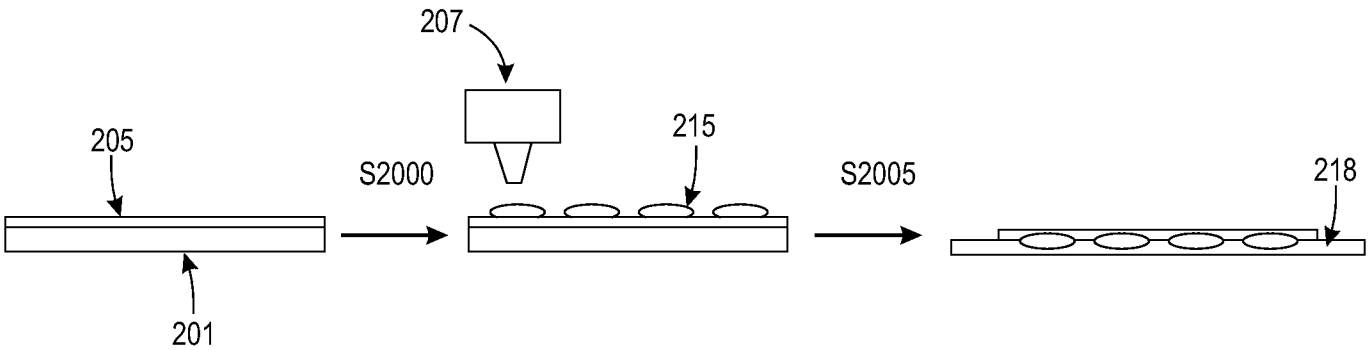
FIG. 2 illustrates a side diagrammatical view of a generic process for jetted ink-based digital transfix printing according to this disclosure.

FIG. 2 illustrates a side diagrammatical view of a generic process for jetted ink-based digital transfix printing according to this disclosure. As shown in FIG. 2, an ink-based digital printing system and a method for ink-based digital printing on an image receiving substrate are provided using a transparent UV-curable base or transfix layer as an intermediate transfer medium.

FIG. 2 shows a receiving member 201 that may generally comprise a low surface tension intermediate transfer blanket, for example a silicone or fluorosilicone transfer blanket. A transparent UV-curable base or transfix layer 205 may be deposited on, and/or formed over, the receiving member 201 and then partially cured in the manner discussed above.

A print head 207 may be provided that is configured to jet aqueous ink onto the transparent UV-curable base or transfix layer coated receiving member 201. The aqueous ink may be jetted from the print head 207 to form an inked image 215 at, for example Step S2000, on the receiving member 201. The UV-curable base or transfix layer 205 may be interposed at this stage between the receiving member 201 and the inked image 215.

The inked image 215 formed on the receiving member 201 may be transferred at, for example Step S2005, to a printable image receiving medium 218 such as paper, plastic, metal, or a broad range of various other suitable media. At S2005, the inked image 215 and the transparent UV-curable base or transfix layer 205 may be transferred to the image receiving medium 218 in a manner that the inked image 215 is interposed between and the transparent UV-curable base or transfix layer 205 and the image receiving medium 218.

Figure 3:
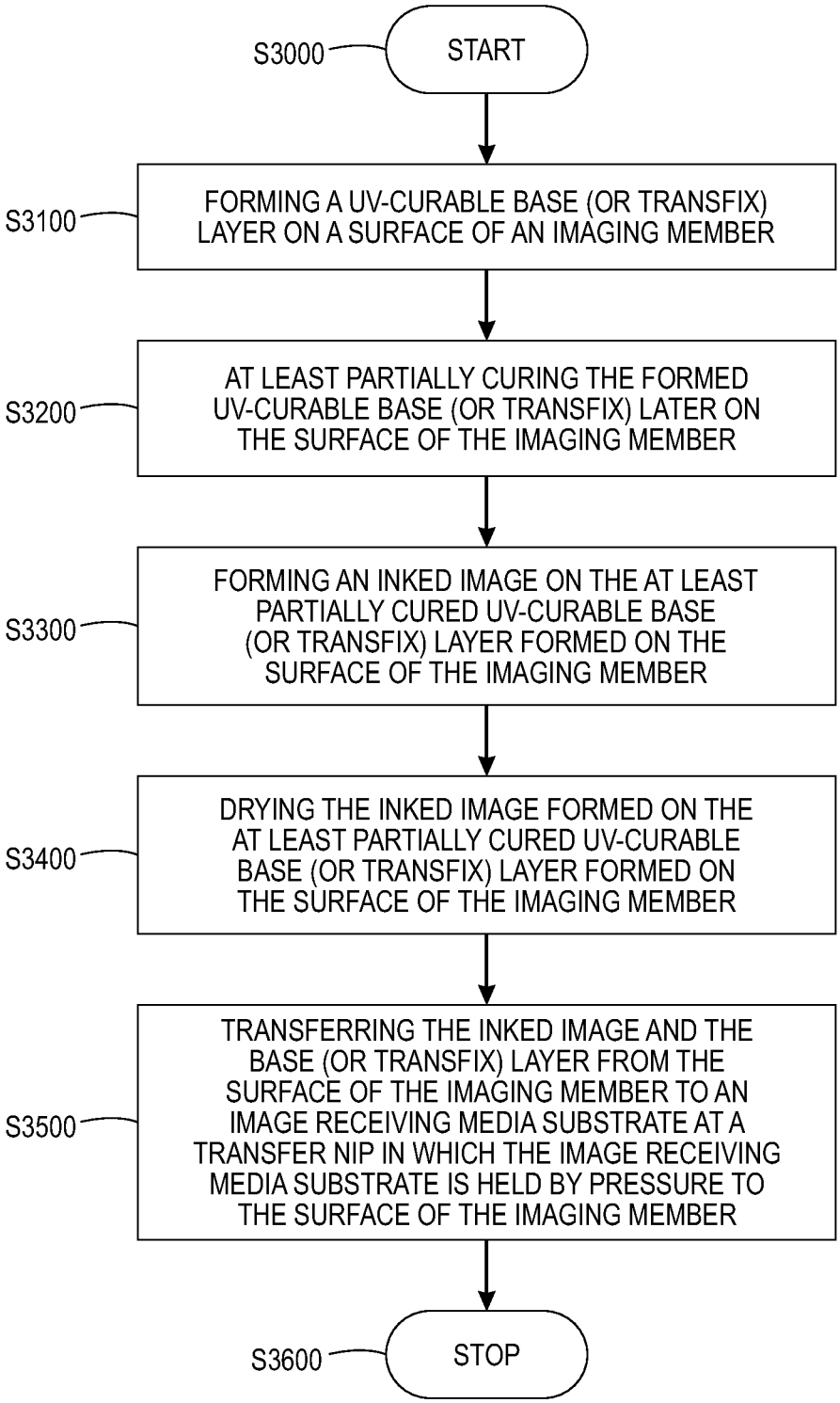
FIG. 3 illustrates a flowchart of an exemplary method for indirect ink-based digital transfix printing according to this disclosure.

The disclosed embodiments may include an exemplary method for indirect ink-based digital transfix printing. FIG. 3 illustrates a flowchart of such an exemplary method. As shown in FIG. 3, operation of the method commences at Step S3000 and proceeds to Step S3100.

In Step S3100, a transparent UV-curable base or transfix layer may be formed on a surface of an intermediate imaging member. The surface of the intermediate imaging member may be formed at least partially of a low surface energy material. Operation of the method proceeds to Step S3200.

In Step S3200, the transparent UV-curable base or transfix layer formed on the surface of the imaging member may be at least partially cured. Operation of the method proceeds to Step S3300.

In Step S3300, an inked image may be formed on the at least partially cured transparent UV-curable base or transfix layer. The inked image may be formed by depositing or otherwise forming an aqueous ink single color or multi-color image on the base or transfix layer using, for example, an ink jetting process, or a variable data digital lithographic image forming process, or another similar ink-based digital image forming or printing technique. Operation of the method proceeds to Step S3400.

In Step S3400, the inked image formed on the at least partially cured UV-curable base or transfix layer may be at least partially dried to remove the water content from the ink forming the inked image. Operation of the method proceeds to Step S3500.

In Step S3500, the inked image and the base or transfixed layer may be transferred from the surface of the imaging member to an image receiving media substrate at a transfer point (including a transfer nip in which the image receiving media substrate may be held by pressure to the surface of the imaging member). The final product will be arranged in such a manner that the inked image is interposed between the transparent UV-curable base or transfix layer and the image receiving media substrate. Operation of the method proceeds to Step S3600, where operation of the method ceases.

The above-described exemplary systems and methods reference certain conventional components to provide a brief, general description of suitable operating, product processing and image forming environments in which the subject matter of this disclosure may be implemented for familiarity and ease of understanding. The illustrations provided in the figures, and the accompanying descriptions, are intended to be illustrative only, and not limiting to the disclosed subject matter.

Those skilled in the art will appreciate that other embodiments of the disclosed subject matter may be practiced in devices, including image forming devices, of many different configurations.

The exemplary depicted sequence of executable instructions represents one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 3, except where a particular method step is a necessary precondition to execution of any other method step.

Experimental Processing

Systems and methods of embodiments were produced and tested in a simulated manner through extensive experimentation. A receiving member or blanket was formed of fully fluorinated fluorosilicone, NUSIL. NUSIL 9667 part A (10 g) and TFT (5 g) was stirred for 10 minutes and to it was added NUSIL 9667 part B (2 g). This was stirred for 15 minutes, and then degassed using a vacuum pump for 15 minutes. The resulting solution was then slit coated onto a 2 mm thick silicone sheet to form a fluorosilicone coating about 120 micron thick. Draw-down coatings of fluorosilicone resulted in glossy, smooth coatings.

A transparent UV-curable base or transfix layer was produced having a formulation as shown in Table 1, below:

TABLE 1

| Component | Weight, g |
|---|---|
| CN249E | 117.00 |
| SR-501 (formerly CD-501) | 9.88 |
| CN3216 | 1.80 |
| Irgacure 379 | 3.60 |
| Irgacure 819 | 2.50 |
| Esacure KIP 150 | 6.52 |

A curing system was implemented that included a UV LED, PHOSEON, 8 w/cm/395 nm.

As a pre-test of the concept, UV transfix layers according to Table 1 above were first spread as thin layers (~1 micron) onto a test blanket with a brayer roller. Separate layers were then treated with the following four levels of partial cure: no partial cure, 0.45 W/cm2 (0.021 J/cm2), 1.6 W/cm2 (0.12 J/cm2), and 2.63 W/cm2 (0.24 J/cm2), and transferred to paper.

Drops of ink then applied with the end of a glass pipette demonstrated increasing edge definition of the large drops as the level of partial cure was increased. This result was experimentally determined to indicate that partial cure, while allowing spread, pins drops and prevents bleed.

It was noted that all UV transfix layers were transferred 100% to the paper, regardless of the level of partial cure applied.

For a systematic demonstration of the print process, thin coatings of the UV-curable transfix layer were applied to transfix blankets, partially cured with varying energy, and printed with aqueous ink using a DIMATIX printer. The test patterns targeted drops with a diameter of 60 microns. The printed layers were subsequently transferred to paper and the prints analyzed. Heat was not applied during any part of the process. Table 2 displays the partial curing conditions and the jetted drop data.

TABLE 2

| Sample | Partial Cure Energy ( /J-cm$^{-2}$) | Drop Diameter (microns) | Perimeter |
|---|---|---|---|
| Pre-Cure 1 | 0.021 | 60.2 ± 6.5 | 188.5 ± 27.8 |
| Pre-Cure 2 | 0.120 | 56.1 ± 5.3 | 175.3 ± 19.6 |
| Pre-Cure 3 | 0.240 | 58.1 ± 6.3 | 182.1 ± 22.9 |

The ink used for testing was commercially available black ink COLLINS 1223. The DIMATIX printer was a DMO model 2800. The sample to be printed was placed onto a plate, which was heated at 40° C. A dot pattern was printed directly onto the blanket. Printing was performed at a drop velocity of 8 m/s and a drop size of 7±0.2 pl volume. This corresponds to a drop size of 23.7 microns in diameter. After printing, the sample was transferred onto a paper substrate using a rubber roller and hand pressure, and the printed dot size was measured using an image analyzer.

The data from Table 2 and experimental results demonstrate that ink drops onto a pre-cured UV-curable layer, followed by transfer to paper, generated the targeted 60 micron drops for the lowest pre-cure condition tested. The drop size slightly increases with increased intensity of pre-cure UV light conditions. It is expected that decreasing the pre-cure energy would increase spreading, if desired, due to a lower viscosity underlying film. The UV formulation is polar, and therefore compatible with the aqueous ink. The relatively high viscosity of the UV-curable transfix layer followed by immediate pre-cure enables full coverage onto the low surface tension blanket.

The above-disclosed systems, methods and fluidic compositions may result in the following advantages:

- Wide substrate latitude, broader than direct to paper applications;
- Potentially suitable for office and production devices alike;
- Robust prints due to a transparent UV-curable transfix layer at a surface of the image receiving media substrate;
- Drop size controlled by partial curing of the UV-curable transfix layer;
- Inks used may be inexpensive pigmented or dye-based aqueous inks; and
- Drying of aqueous inks may be minimized due to some water absorption into the UV-curable transfix layer, and then absorption into paper stock.

It will be appreciated that the above-disclosed and other features and functions, or alternatives thereof, may be desirably combined into many other different systems, methods, or applications. Also, various presently unforeseen or unanticipated alternatives, modifications, variations or improvements therein may be subsequently made by those skilled in the art.

What is claimed is:

1. An image marking device, comprising:

a liquid source that provides a transparent radiation curable liquid;

an intermediate member having a surface that receives the transparent radiation curable liquid from the liquid source as a layer of the transparent radiation curable liquid being formed on the intermediate member;

a surface curing unit positioned downstream of the liquid source in a process direction that at least partially cures the layer of the transparent radiation curable liquid on the intermediate member to produce an at least partially cured base layer; and an aqueous ink delivery unit positioned downstream of the surface curing unit in a process direction that delivers aqueous ink onto the at least partially cured base layer to form an image on the at least partially cured base layer according to image data inputs to the aqueous ink delivery unit, a transfer station that transfers the formed image and at least a portion of the at least partially cured base layer from the intermediate member to an image receiving media substrate, the formed image being sandwiched between the image receiving media substrate and the at least partially cured base layer after the transfer.

2. The image marking device of claim 1, the aqueous ink delivery unit comprising one or more inkjet print heads that deliver the aqueous ink onto the base layer by jetting the aqueous ink onto the base layer.

3. The image marking device of claim 1, the aqueous ink delivery unit comprising a variable data lithographic image forming device that delivers the aqueous ink onto the base layer by transferring the ink from a reimageable surface of an imaging member onto the base layer.

4. The image marking device of claim 1, the surface of the intermediate member being formed of a low surface energy material.

5. The image marking device of claim 4, the low surface energy material being one of a silicone or a fluorosilicone.

6. The image marking device of claim 1, the surface curing unit curing the layer of the transparent radiation curable liquid formed on the intermediate member to a point that limits a spreading of the aqueous ink delivered onto the base layer.

7. The image marking device of claim 1, the surface curing unit curing the layer of the transparent radiation curable liquid formed on the intermediate member to a point that facilitates transfer of substantially all of the base layer to the image receiving media substrate.

8. The image marking device of claim 1, further comprising a surface drying unit positioned downstream of the aqueous ink delivery unit in a process direction, the surface drying unit located adjacent the aqueous ink and opposite the intermediate member, and configured to dry the aqueous ink on the base layer via evaporation by raising the temperature of the aqueous ink.

9. The image marking device of claim 8, a level of drying of the aqueous ink on the base layer being based on at least one of a level of liquid absorption of the base layer, a level of liquid absorption of the image receiving media substrate and an area coverage of the formed image on the base layer.

10. The image marking device of claim 1, further comprising an opposing pressure member, the formed image and the at least the portion of the base layer being transferred to the image receiving media substrate at a transfer nip formed between the intermediate member and the opposing pressure member.

11. The image marking device of claim 1, the surface curable unit exposing the radiation curable liquid layer on the intermediate member to radiation with the radiation curable liquid layer being free of ink during the exposure to produce at least a partially cured ink-free base layer.

12. The image marking device of claim 1, the transparent radiation curable liquid being UV curable, the surface curing unit exposing the layer of the radiation curable liquid formed on the intermediate member to UV radiation.

13. A method for forming images on image receiving media substrates, comprising:

providing a source of a transparent radiation curable liquid in an image forming device;

forming a layer of the transparent radiation curable liquid on an intermediate image transfer member in the image forming device;

at least partially curing the layer of the transparent radiation curable liquid formed on the intermediate image transfer member to produce an at least partially cured base layer;

delivering aqueous ink onto the at least partially cured base layer to form an image on the at least partially cured base layer according to image data inputs to an aqueous ink delivery unit in the image forming device; and transferring the formed image and at least a portion of the at least partial iv cured base layer to an image receiving media substrate, the formed image being sandwiched between the image receiving media substrate and the at least partially cured base layer after the transferring.

14. The method of claim 13, the aqueous ink delivery unit comprising one or more inkjet print heads that deliver the aqueous ink onto the base layer by jetting the aqueous ink onto the base layer.

15. The method of claim 13, the aqueous ink delivery unit comprising a variable data lithographic image forming device that delivers the aqueous ink onto the base layer by transferring the ink from a reimageable surface of an imaging member onto the base layer.

16. The method of claim 13, the surface curing unit curing the layer of the transparent radiation curable liquid formed on the intermediate image transfer member to a point that limits a spreading of the aqueous ink delivered onto the base layer.

17. The method of claim 13, the surface curing unit curing the layer of the transparent radiation curable liquid formed on the intermediate image transfer member to a point that facilitates transfer of substantially all of the base layer to the image receiving media substrate.

18. The method of claim 13, further comprising separately drying the aqueous ink delivered onto the base layer via evaporation of water content out of the aqueous ink with a surface drying unit adjacent the aqueous ink and opposite the intermediate member raising the temperature of the aqueous ink.

19. The method of claim 18, a level of drying of the aqueous ink on the base layer being based on at least one of a level of liquid absorption of the base layer, a level of liquid absorption of the image receiving media substrate and an area coverage of the formed image on the base layer.

20. The method of claim 13, transferring the formed image and the at least the portion of the base layer to the image receiving media substrate at a transfer nip formed between the intermediate image transfer member and an opposing pressure member.

21. The method of claim 13, the step of at least partially curing the layer of the transparent radiation curable liquid on the intermediate image transfer member to produce the at least partially cured base layer further comprising at least partially curing the layer of the transparent radiation curable liquid on the intermediate image transfer member, with the layer of the transparent radiation curable liquid being ink-free, to produce an ink-free base layer.

22. The method of claim 13, the transparent radiation curable liquid being UV curable, the surface curing unit exposing the layer of the radiation curable liquid formed on the intermediate image transfer member to UV radiation.

23. An image forming system, comprising:

an image receiving media substrate source;

an image data input;

a media marking device that comprises:

a liquid source that provides an inkless transparent radiation curable liquid in the media marking device;

an intermediate image transfer member having a surface that receives the transparent radiation curable liquid from the liquid source as an ink-free layer of the transparent radiation curable liquid being formed on the intermediate image transfer member;

a surface curing unit positioned that at least partially cures the ink-free layer of the transparent radiation curable liquid on the intermediate image transfer member to produce an at least partially cured ink-free base layer; and an aqueous ink delivery unit that delivers aqueous ink onto the at least partially cured ink-free base layer to form an image on the at least partially cured base layer according to image data inputs to the aqueous ink delivery unit from the image data unit, the formed image and at least a portion of the at least partially cured base layer being transferred to an image receiving media substrate transported from the image receiving media substrate source to the media marking device, the formed image being sandwiched between the image receiving media substrate and the at least partially cured base layer after the transfer; and a final curing device that is positioned downstream of the media marking device in a process direction that fixes the formed image and the at least partially cured base layer on the image receiving media substrate prior to output as a competed document.

* * * * *